US006641118B2

(12) United States Patent
Schliemann

(10) Patent No.: US 6,641,118 B2
(45) Date of Patent: Nov. 4, 2003

(54) CARBURETOR ARRANGEMENT

(75) Inventor: Harald Schliemann, Waiblingen (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 10/243,741

(22) Filed: Sep. 16, 2002

(65) Prior Publication Data

US 2003/0052422 A1 Mar. 20, 2003

(30) Foreign Application Priority Data

Sep. 14, 2001 (DE) ..... 101 45 293

(51) Int. Cl.[7] ..... F02M 1/02
(52) U.S. Cl. ..... 261/52; 261/64.1; 261/65
(58) Field of Search ..... 261/52, 65, 64.1, 261/64.4

(56) References Cited

U.S. PATENT DOCUMENTS 2,836,404 A * 5/1958 Carlson et al. ..... 261/23.2
2,982,275 A * 5/1961 Doman et al. ..... 123/198 DC
3,575,385 A * 4/1971 Szwargulski et al. ..... 261/23.2
3,823,700 A * 7/1974 Gumtow ..... 123/395
3,886,917 A * 6/1975 Nakada et al. ..... 261/39.4
4,123,480 A 10/1978 Johansson ..... 261/52
4,137,283 A * 1/1979 Couderc ..... 261/39.3
4,192,834 A * 3/1980 Berkbigler ..... 261/52
5,500,159 A * 3/1996 Martinsson ..... 261/52
5,611,312 A * 3/1997 Swanson et al. ..... 123/436
5,891,369 A * 4/1999 Tuggle et al. ..... 261/35
6,000,683 A * 12/1999 Van Allen ..... 261/52
6,202,989 B1 * 3/2001 Pattullo ..... 261/52
6,439,547 B1 * 8/2002 King et al. ..... 261/52
6,454,245 B2 * 9/2002 Kobayashi ..... 261/52
6,494,439 B1 * 12/2002 Collins ..... 261/52
6,550,749 B2 * 4/2003 Vick ..... 261/52
6,561,496 B2 * 5/2003 Gliniecki et al. ..... 261/52

* cited by examiner

*Primary Examiner*—Richard L. Chiesa
(74) *Attorney, Agent, or Firm*—Walter Ottesen

(57) ABSTRACT

A carburetor arrangement for an internal combustion engine including a two-stroke engine in a portable handheld work apparatus includes an intake channel section (2) which is formed in the carburetor housing (34). A throttle flap (3) is arranged in the intake channel section and is rotatably held by a throttle flap shaft (4). Fuel-conducting channels open into the intake channel section (2) in the region of the throttle flap. A choke flap (5) is mounted upstream of the throttle flap (3) in the intake channel section (2). The choke flap (5) is held by a choke shaft (6) so as to be rotatable. The throttle flap (3) is displaced in a closing direction from an opening position into a closed position and in an opening direction from the closed position into the open position. The same applies to the choke flap (5). The choke flap (5) and the throttle flap (3) are mechanically coupled. The choke shaft (6) is actuable by an operator-controlled element. A choke lever (9) is mounted on the choke shaft 6 so that it cannot rotate relative thereto and a throttle lever (8) is mounted on the throttle shaft (4) so that it cannot rotate relative thereto. The choke lever (9) and the throttle lever (8) are in mutual engagement in a pregiven angular range of the position of the choke shaft (6) and an assigned angular range of the position of the throttle shaft (4).

15 Claims, 4 Drawing Sheets

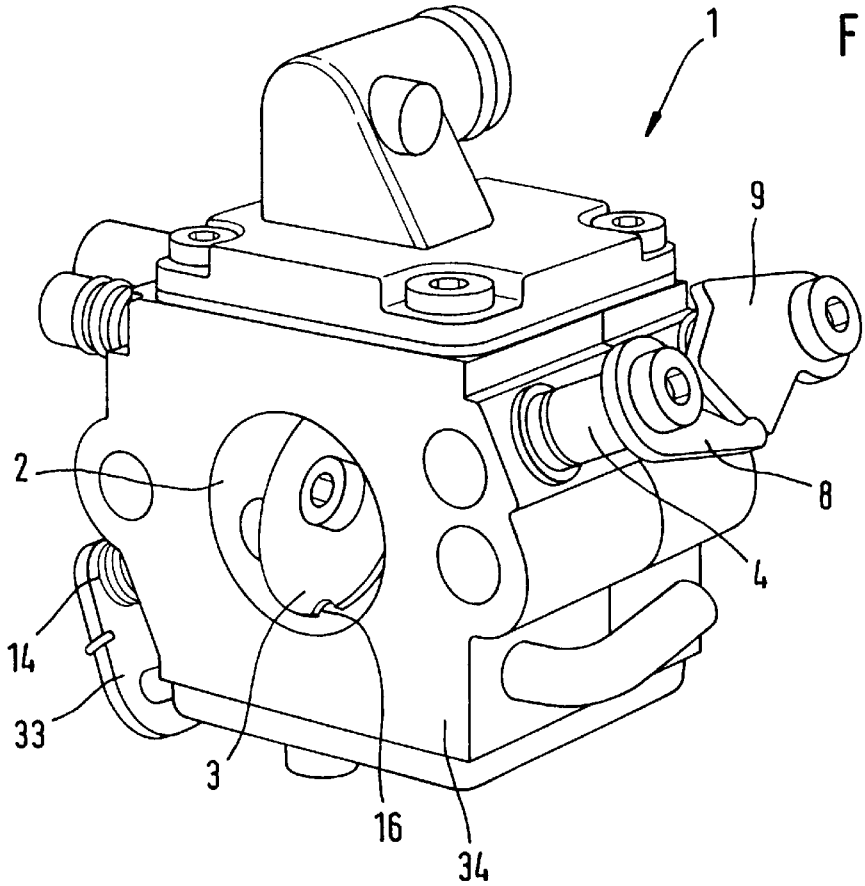
Fig. 5
Fig. 6
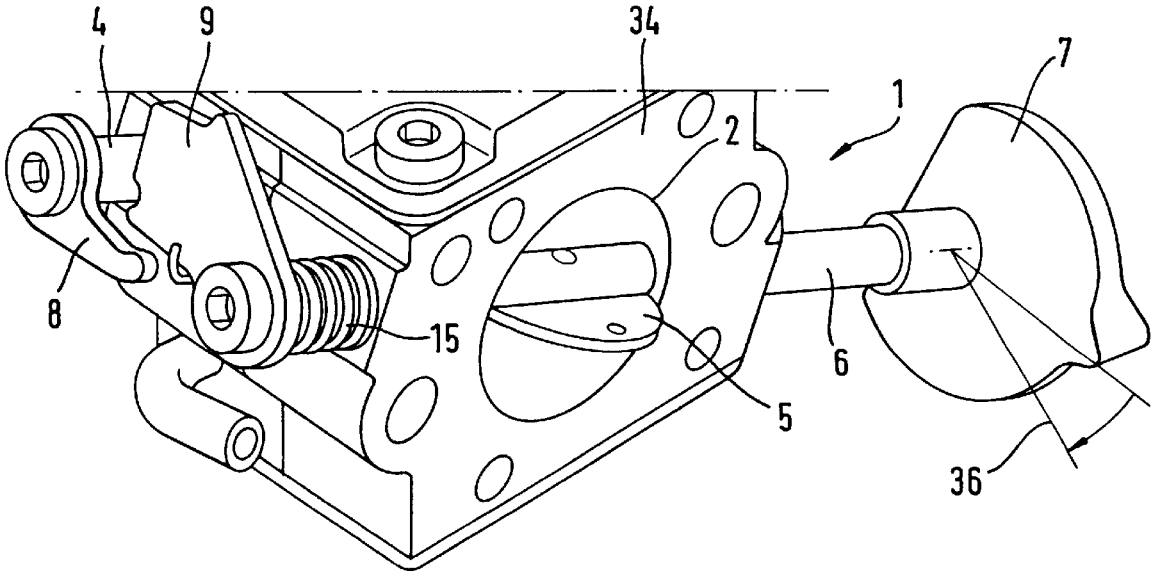

CARBURETOR ARRANGEMENT

BACKGROUND OF THE INVENTION

U.S. Pat. No. 4,123,480 discloses a carburetor arrangement which includes a throttle flap and a choke flap. A rotatably journalled lever is mounted on the choke shaft and this lever comes into engagement with a lever mounted on the throttle shaft so as to rotate therewith. A drag lever is mounted on the choke shaft so as to rotate therewith and is actuated by an operator-controlled element and entrains the lever, which is rotatably mounted on the choke shaft, in a rotatable direction when there is contact with a blocking element. The operator cannot bring the carburetor directly from the idle position into the warm-start position; instead, the cold-start position must first be adjusted and from there moved into the warm-start position. This manipulation is inconvenient. The manufacture of the carburetor arrangement is complex because the three levers must be arranged in defined positions relative to each other in order to ensure the function for a good starting performance.

SUMMARY OF THE INVENTION

It is an object of the invention to provide a carburetor arrangement which is simple with respect to its manipulation by an operator and in its configuration.

The carburetor arrangement of the invention is for an internal combustion engine including a two-stroke engine in a portable handheld work apparatus. The carburetor arrangement includes: a carburetor housing defining an intake channel formed therein for conducting combustion air and fuel to the engine in a predetermined flow direction; a throttle shaft rotatably mounted in the carburetor housing and a throttle flap mounted on the throttle shaft; a choke shaft rotatably mounted in the carburetor housing upstream of the throttle shaft and a choke flap mounted on the choke shaft; the throttle flap being movable from an open position, whereat the throttle flap does not significantly influence the flow in the intake channel, into a closed position whereat the throttle flap closes the intake channel; the choke flap being movable from an open position, whereat the choke flap does not significantly influence the flow in the intake channel, into a closed position whereat the choke flap closes the intake channel; the throttle flap and the choke flap being displaceable from the closed position thereof into the open position; an operator-controlled element operatively connected to the choke shaft for actuating the choke shaft; a choke lever mounted on the choke shaft so that the choke lever cannot rotate relative to the choke shaft; a throttle lever mounted on the throttle shaft so that the throttle lever cannot rotate relative to the throttle shaft; means for mutually engaging the choke lever and the throttle lever in a first angular range of the position of the choke shaft and a corresponding second angular range of the position of the throttle shaft; and, in the second angular range, an idle position, a warm-start position and a cold-start position are provided arranged one behind the other.

Only two levers are needed via which the idle position, the warm-start position and the cold-start position can be set. The levers mutually engage in both rotating directions, that is, in the closing direction as well as in the opening direction so that the sequence, in which the operating positions are set, is freely selectable. An operator can set the warm-start position as well as the cold-start position directly from the idle position and can change between these positions as desired.

The choke shaft is resiliently biased in the opening direction. For the choke flap, it can, however, be provided that it is held in the closed position and in the open position via a resiliently biased latch element which operates especially on the choke shaft. It is practical that the throttle shaft be spring biased in the closing direction. It is further provided that the resulting torque on the choke shaft acts in the closing direction of the choke flap when in the cold-start position. With this configuration, the choke flap lies seal tight in the closing direction in the intake channel section. It is practical that the throttle lever is decoupled from the choke lever in the opening direction of the throttle flap. With the choke shaft being spring biased in the opening direction, the choke flap jumps back into the idle position in this way (that is, into its open position) with the actuation of the throttle flap, for example, by means of a throttle pull acting on the throttle shaft. In this way, the operator need not reset the choke shaft into the operating position by means of the operator-controlled element; instead, this is achieved in a simple manner by pulling on the throttle.

The choke flap is mounted in the closed position with play in the closing direction in the intake channel section. The choke flap is brought into contact engagement on the intake channel section via the torque acting in the closing direction of the choke flap and being caused by the spring forces and the geometry of the levers. In this way, the choke flap can be reliably closed independently of manufacturing tolerances. In the warm-start position, the throttle lever latches into an indent in the choke lever. The levers mutually touch especially in the region of an arcuate-shaped surface. With this geometry, the torque, which is necessary in order to rotate the choke shaft, is determined by the contact points on the contact surface with the contact points being on the outside in the direction of rotation. Because of the location of the contact points, the torque can be adjusted for both rotation directions independently of each other in a specific region. In a practical manner, the throttle lever lies against a side of the choke lever in the cold-start position. In this way, the positions of the levers to each other are not precisely determined and the choke shaft can be rotated to compensate for manufacturing tolerances in the closed position until the choke flap lies against the intake channel section. The operator-controlled element engages the choke shaft via a gearing and the ratio from the operator-controlled element to the choke element is especially greater than one. The rotational angles of the choke shaft are determined by the geometry of the carburetor. With the gearing, larger rotational angles can be achieved at the operator-controlled element which facilitates the adjustability of the various positions. It can be advantageous to arrange the operator-controlled element so that it is fixed on the choke shaft so that it cannot rotate with respect thereto. In this way, an especially simple configuration of the carburetor arrangement is provided.

Advantageously, the operator-controlled element is decoupled from the choke shaft in the closed position in the closing direction and an ignition-off position is disposed at a pregiven angular distance to the normal operation position. With this configuration, no further operator-controlled elements for setting operating positions are needed. It is practical to arrange a latch element in the opening direction in the idle position which prevents an unwanted rotation of the operator-controlled element.

BRIEF DESCRIPTION OF THE DRAWINGS

The invention will now be described with reference to the drawings wherein:

FIG. 5 is a view of the carburetor arrangement of FIG. 4 with the throttle flap shown in the warm-start position;

FIG. 6 is a view of the carburetor arrangement according to FIG. 4 with the opened choke flap shown in the idle position;

DESCRIPTION OF THE PREFERRED EMBODIMENTS OF THE INVENTION

Figure 4:
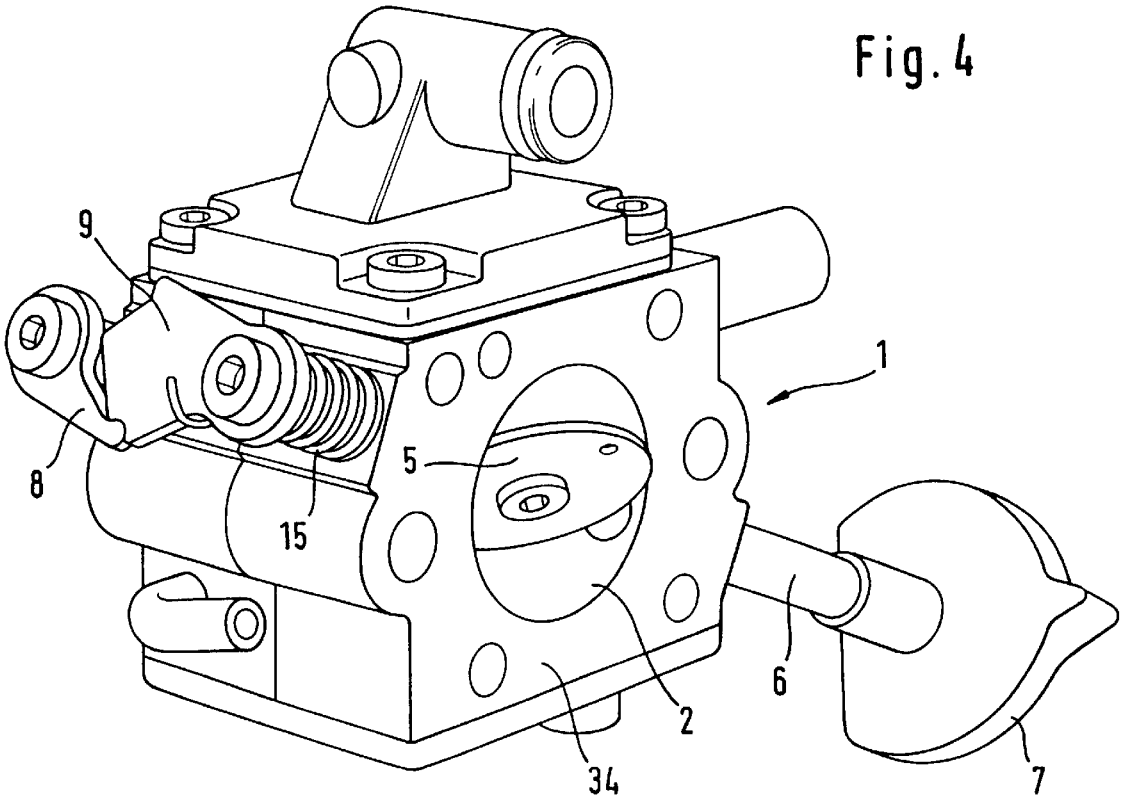
FIG. 4 is a perspective view of a carburetor arrangement having an operator-controlled element mounted on the choke shaft with the choke flap shown in the warm-start position.

A carburetor arrangement is shown in FIGS. 4 and 5 and is configured as a membrane carburetor arrangement. The membrane carburetor arrangement includes an intake channel section 2 which functions for supplying combustion air to the combustion chamber of an engine (not shown). In the intake channel section 2, a throttle flap 3 having a throttle shaft 4 and a choke flap 5 having a choke shaft 6 are rotatably journalled. The throttle flap 3 is mounted in the direction of the combustion air flowing through the intake channel section 2 downstream of the choke flap 5. In the region of the throttle flap 3, fuel conducting channels open into the intake channel section 2 and supply fuel to the combustion air. Outside of the intake channel section 2, an operator-controlled element 7 is advantageously mounted on the outer end of the choke shaft 6 so that it cannot rotate relative thereto. The choke shaft 6 can be rotated about its axis with the operator-controlled element 7.

On the side of the intake channel section 2 lying opposite the operator-controlled element 7, there is a choke lever 9 mounted on the choke shaft 6 so that it cannot rotate relative thereto. In FIGS. 4 and 5, the choke lever 9 is in engagement with a throttle lever 8 which is mounted on the throttle shaft 4 so that it cannot rotate relative thereto. The throttle flap 3 is resiliently biased in the closing direction by a spring 14 shown in FIG. 5. The spring 14 acts in the direction of rotation from an open position (in which the throttle flap 3 lies approximately parallel to the longitudinal axis of the intake channel section 2) into a closed position in which it closes the intake channel section 2. The choke flap 5 is resiliently biased by a spring 15 (shown in FIG. 4) in the opening direction, that is, in the rotation direction from the closed position into the open position. The opening direction of the choke flap 5 is in the same direction as the opening direction of the throttle flap 3, that is, the flaps are spring biased in opposite directions. However, it can be advantageous that the choke flap 5 is held in the closed position and in the opening position via a spring biased latch element which acts especially on the choke shaft 6. Advantageously, the latch element is configured as a spring-biased ball which latches in grooves which, for example, run on the choke shaft 6 in the axial direction.

Figure 1:
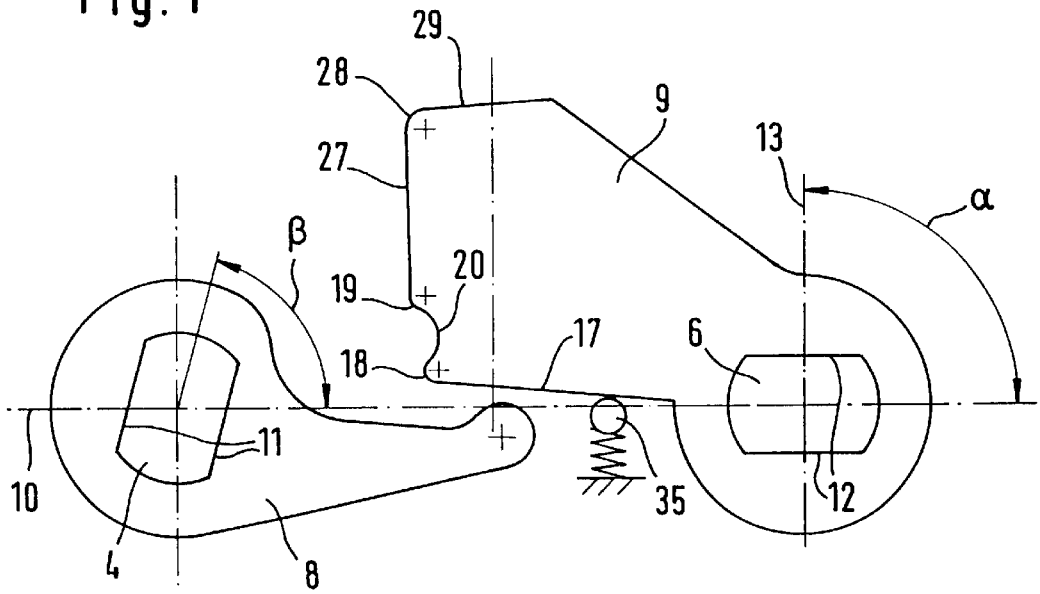
FIG. 1 is a schematic side elevation view toward the ends of the throttle shaft and choke shaft with levers mounted thereon and in the idle position.

In FIG. 1, levers 8 and 9 are shown in the idle position. An imaginary axis 10 perpendicularly connects the throttle shaft 4 and the choke shaft 6 and lies parallel to the longitudinal axis of the intake channel section 2. The throttle flap 3 is fixed approximately parallel to the flats 11 on the throttle shaft 4 and the choke flap 5 is fixed parallel to the flats 12 on the choke shaft 6. The flats (11, 12) define a rotation-tight, form-tight connection between the levers (8, 9) and the throttle shaft 4 and the choke shaft 6, respectively. This connection can, however, be established with other connecting means such as the threaded fasteners shown in FIGS. 4 to 8. It is also practical to use other force-tight connections.

The position angle $\alpha$, which the choke flap 5 encloses with the axis 13 arranged perpendicularly to the axis 10, is 90° in the idle position because the choke flap 5 is disposed in the open position. In FIG. 6, the position of the choke flap 5 is shown in connection with the position of the levers (8, 9) and the operator-controlled element 7. The throttle flap 3 is in the idle position in the closed position and, with the axis 10, encloses a position angle $\beta$ of approximately 75°. The torque, which is applied by the spring 14 to the throttle shaft 4, operates in the closing direction. For this reason, the throttle flap 3 is pressed into contact engagement against the wall of the intake channel section 2 and closes the same up to a residual cross section. During idle operation, combustion air enters through the arcuately-shaped cutout 16 shown in FIG. 5. The levers (8, 9) are decoupled from each other in the idle position. The throttle flap 3 can be actuated in the opening direction by means of a throttle pull acting on the throttle shaft 4 without coming into engagement with the choke lever 9.

Figure 2:
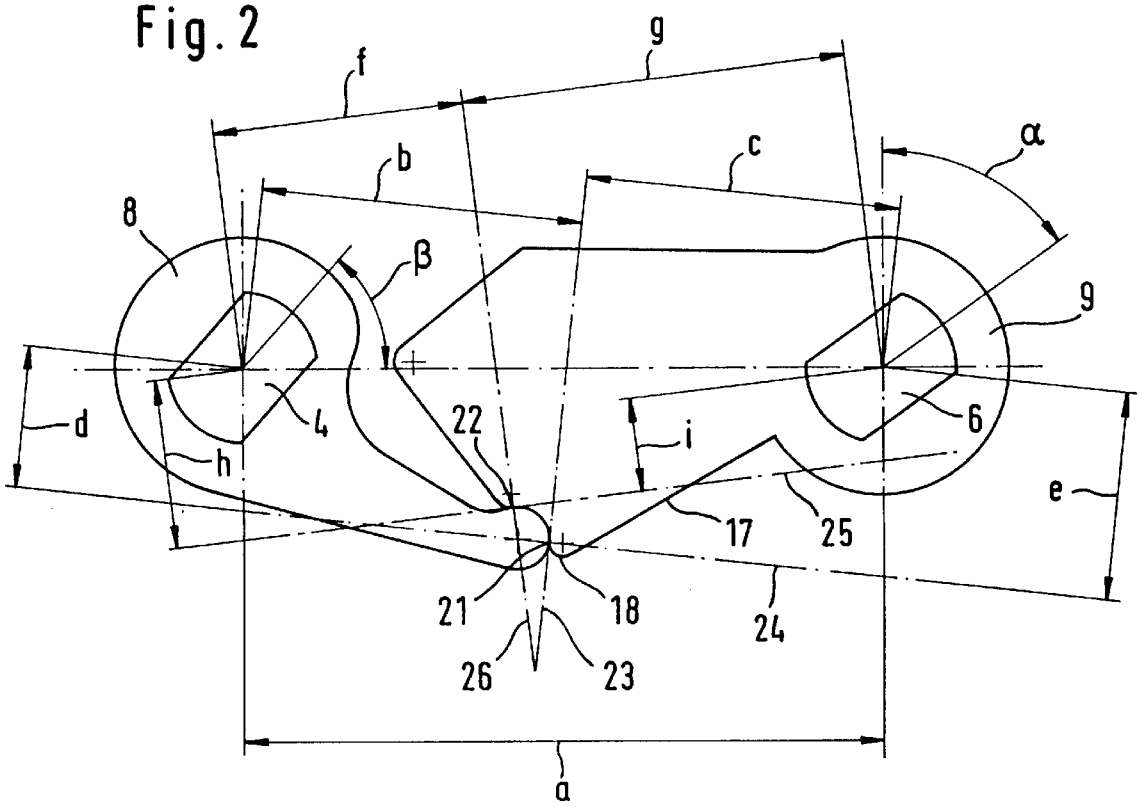
FIG. 2 is a view according to FIG. 1 with the levers in the warm-start position.

In FIG. 2, the throttle lever 8 and the choke lever 9 are shown in the warm-start position. The warm-start position can be arrived at by rotating the operator-controlled element 7 from the position shown in FIG. 6 into the position shown in FIG. 4. If, as shown in FIG. 4, the operator-controlled element 7 is connected to the choke shaft 6 so that it cannot rotate relative thereto, then the rotation angle, which is necessary to reach the warm-start position from the idle position, corresponds to the difference between the position angle $\alpha$ in the idle position and the position angle $\alpha$ in the warm-start position. In the warm-start position, the position angle $\alpha$ of the choke flap amounts to approximately 55°, so that the operator-controlled element 7 has to be displaced by a rotational angle of approximately 35° from the idle position into the warm-start position. The position angle $\beta$ of the throttle flap amounts to approximately 48°. The corresponding position of the choke flap 5 is shown in FIG. 4 and that of the throttle flap 3 is shown in FIG. 5. With the geometries of the choke lever 9 and the throttle lever 8, and depending upon the wanted opening angle of the choke flap 5 and the throttle flap 3, angles departing therefrom can be adjusted. If the position angle $\beta$ is less than provided for in the warm-start position, then the levers (8, 9) do not latch and the operator-controlled element 7 is reset into the idle position by the spring 15. In this way, it is ensured that, during operation, an unwanted actuation of the operator-controlled element 7 does not cause a start position of the choke flap 5.

In the transition from idle position to warm-start position, the throttle lever 8 comes into contact engagement with the side 17 of the choke lever 9. The side 17 runs radially to the choke shaft 6 and continues into the rounded edge 18. The throttle lever 8 latches in the warm-start position in the indent 20 which is disposed between the rounded edges 18 and 19. The levers (8, 9) are in mutual contact in the region of an arcuately-shaped surface in the indent 20 between the contact points 21 and 22. The forces and torques, which act on the levers (8, 9) result from the torques, which are generated by the springs 14 and 15 on the choke shaft 6 and the throttle flap 4 and from the geometries of the throttle lever 8 and choke lever 9.

The distances of the tangents 23 and the normal 24 at contact point 21 to the throttle shaft 4 and to the choke shaft 6 determine (in dependence upon the coefficient of friction) the torque which must be overcome in the opening direction of the choke flap 5 for rotating the choke shaft 6 and the distances of the tangents 25 and the normal 26 at contact point 22 to the throttle shaft 4 and the choke shaft 6 determine the torque which is to be overcome in the closing direction of the choke flap 5. The distance here is the distance to the shaft axis. The distance (b) of the tangent 23 to the throttle shaft 4 is, in FIG. 2, approximately 10 mm and the distance (c) to the choke shaft 6 is approximately 9.7 mm. The distance (d) of the normal 24 to the throttle shaft 4 amounts approximately to 4.4 mm and the distance (e) to the choke shaft 6 is approximately 6.4 mm. The torque, which is to be overcome in the opening direction of the choke flap 5, is adjusted via these distances. The distance (a) of the choke shaft 6 to the throttle shaft 4 is approximately 19.8 mm.

Correspondingly, the torque, which is to be overcome in the closing direction of the choke flap 5, can be adjusted via the distance (f) of the normal 26 to the throttle shaft 4 and the distance (g) to the choke shaft 6 and the distance (h) of the tangents 25 to the throttle shaft 4 as well as the distance (i) to the choke shaft 6. The distance (f) can be approximately 7.8 mm and the distance (g) can be approximately 11.9 mm and the distance (h) can be approximately 5.3 mm and the distance (i) can be approximately 2.9 mm. In FIG. 4, the position of the choke flap 5 which results because of the lever geometry, is shown and, in FIG. 5, the resulting position of the throttle flap 3 is shown.

Figure 3:
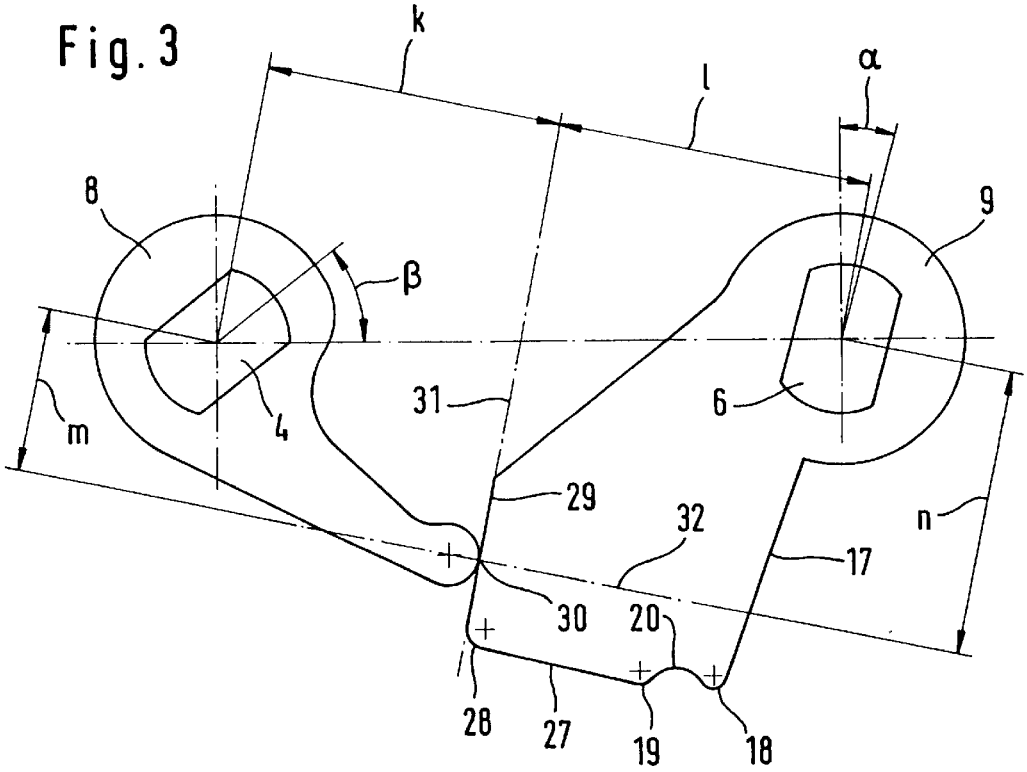
FIG. 3 is a view corresponding to FIG. 1 with the levers in the cold-start position.

The cold-start position shown in FIG. 3 is reached when the choke shaft 6 is rotated from the warm-start position by approximately 40° in the closing direction thereof. When rotating the choke shaft 6 from the warm-start position into the cold-start position, the lever 8 slides over the side 27 and the rounded edge 28 and comes into contact at the side 29 of the lever 9. The lever 8 touches the lever 9 in the cold-start position at contact point 30. The position angle $\alpha$ of the choke flap is approximately 15° in the cold-start position and the position angle $\beta$ of the throttle flap is approximately 37.5°. The torque, which acts on the throttle shaft 4, is greater than the torque acting on the choke shaft 6. In this way, and because of the geometry of the levers (8, 9), a torque acts in the closing direction of the choke flap 5 in the cold-start position via which the choke flap 5 is held closed. In this way, manufacturing tolerances, which make a complete closure in the cold-start position difficult, are substantially cancelled.

Figure 7:
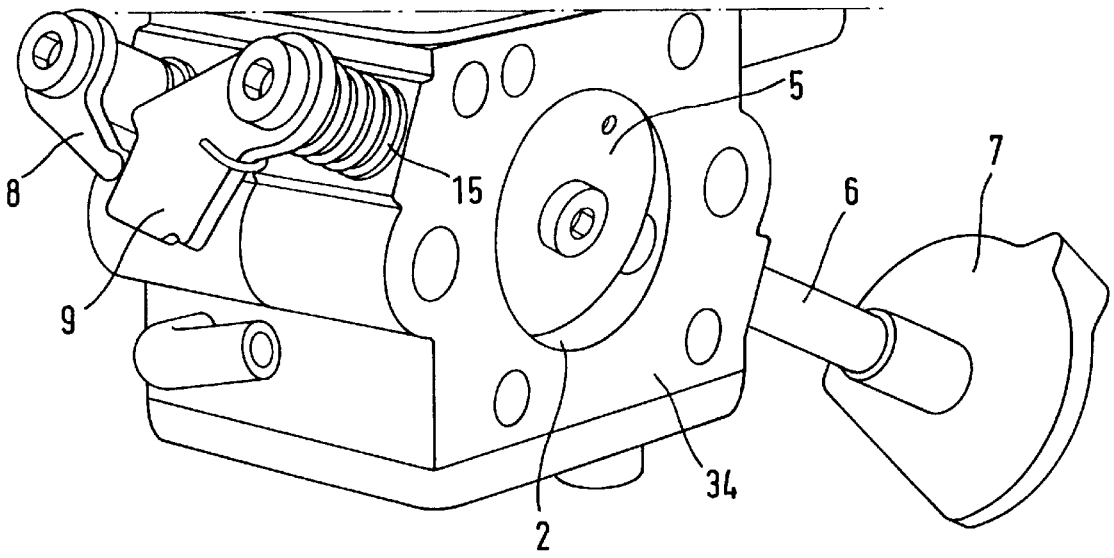
FIG. 7 is a view of the carburetor arrangement of FIG. 4 with the closed choke flap shown in the cold-start position; and, FIG. 8 is a view of the carburetor arrangement of FIG. 4 with the throttle flap shown in the cold-start position.
Figure 8:
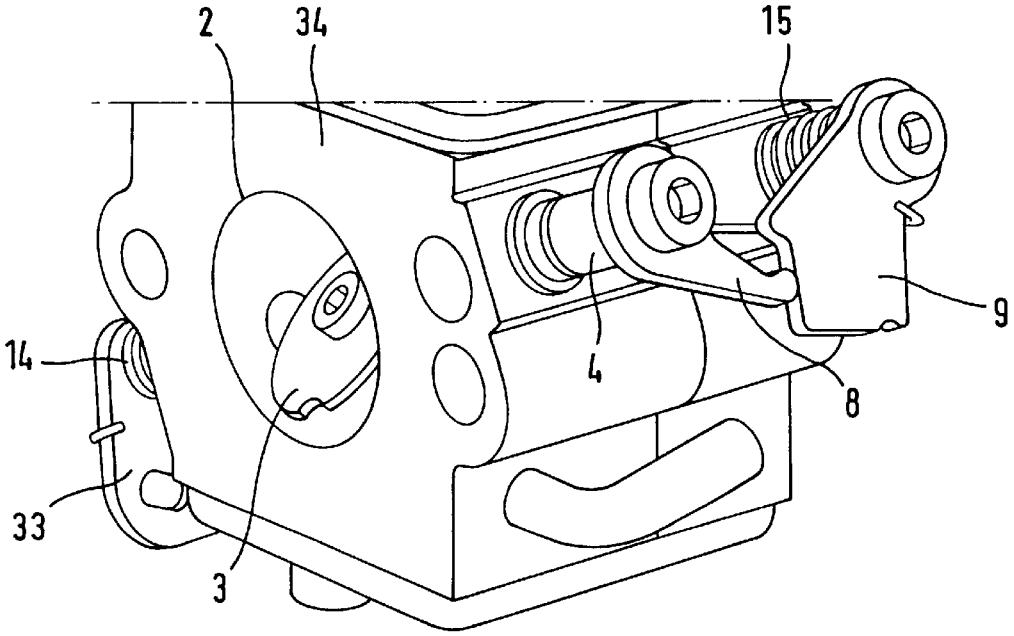

The distance (k) of the tangent 29 at the contact point 30 to the throttle flap 4 is approximately 9.5 mm and the distance (1) to the choke shaft 6 is approximately 9.9 mm. The distance (m) of the normal 32 to the throttle shaft 4 is approximately 5.2 mm and the distance (n) to the choke shaft 6 is approximately 9.0 mm. These distances can be varied in dependence upon the manufacturing tolerances. The position of the choke flap 5 for this lever geometry is shown in FIG. 7 and the position of the throttle flap 3 is shown in FIG. 8. Other geometries can be advantageous to set other acting torques or flap positions. The geometry of the edge 28 determines the torque which must be overcome in order to change over from the warm-start position into the cold-start position and vice versa.

The choke flap 5 is not completely open in the warm-start position. This partially opened position is at least partially compensated by the throttle flap 3, which is open farther in the warm-start position, so that favorable warm-start and cold-start conditions can adjust.

The throttle flap 3 can be actuated in every lever position. With the actuation of the throttle flap 3, the throttle lever 8 is released from the choke lever 9 and the choke lever 9 jumps into the open position because of the spring force of the spring 15. In FIG. 8, a lever 33 is shown, which is mounted on the end of the throttle shaft 4 which faces away from the throttle lever 8 and on which end a throttle pull can be arranged which actuates the throttle flap 3. The throttle pull can, however, also be mounted directly on the throttle lever 8 which, in this case, shows an attachment possibility for the throttle pull.

The operator-controlled element 7 need not be connected to the choke shaft 6 so that it cannot rotate relative thereto. An ignition-off position 36 can be especially provided on the operator-controlled element 7. For this purpose, the operator-controlled element 7, in the angular region between the idle position and the cold-start position, is coupled to the choke shaft 6, for example, via a gear unit. In the idle position, the operator-controlled element 7 is decoupled from the choke shaft 6 in the opening direction of the choke flap 5 and can, for example, be spring-mounted. A contact can be provided in a specific angular position of the operator-controlled element 7 away from the idle position with this contact actuating an ignition-off function. In this way, a separate switch for switching off the ignition can be saved. In a specific angular region, the operator-controlled element 7 can be arranged on the choke shaft 6 so that it cannot rotate relative thereto and exhibit a movement relative to the choke shaft 6 in a specific angular range. In this way, an enlarged pivot range of the operator-controlled element 7 is obtained.

The operator-controlled element 7 can be connected to the choke shaft 6 via a gearing unit in order to facilitate the adjustment of the different positions of the choke flap 5 on the operator-controlled element for the operator. For clearly separated and simply selectable operator-controlled element positions, the transmission ratio of the gearing assembly can be greater than one so that the angles between the operating positions are increased.

A block against unwanted actuation of the operator-controlled element 7 can be realized by a block element 35. This can, for example, be a spring element which hinders the rotational movement of the operator-controlled element 7 as long as it is not released. A latch element is also possible which is released by a combined movement of the operator-controlled element 7, for example, by pressing in the axial direction and a rotation of the operator-control element 7.

It is understood that the foregoing description is that of the preferred embodiments of the invention and that various changes and modifications may be made thereto without departing from the spirit and scope of the invention as defined in the appended claims.

What is claimed is:

1. A carburetor arrangement for an internal combustion engine including a two-stroke engine in a portable handheld work apparatus, the carburetor arrangement comprising:

a carburetor housing defining an intake channel formed therein for conducting combustion air and fuel to said engine in a predetermined flow direction;

a throttle shaft rotatably mounted in said carburetor housing and a throttle flap mounted on said throttle shaft;

a choke shaft rotatably mounted in said carburetor housing upstream of said throttle shaft and a choke flap mounted on said choke shaft;

said throttle flap being movable from an open position, whereat said throttle flap does not significantly influence the flow in said intake channel, into a closed position whereat said throttle flap closes said intake channel;

said choke flap being movable from an open position, whereat said choke flap does not significantly influence the flow in said intake channel, into a closed position whereat said choke flap closes said intake channel;

said throttle flap and said choke flap being displaceable from the closed position thereof into said open position;

an operator-controlled element operatively connected to said choke shaft for actuating said choke shaft;

a choke lever mounted on said choke shaft so that said choke lever cannot rotate relative to said choke shaft;

a throttle lever mounted on said throttle shaft so that said throttle lever cannot rotate relative to said throttle shaft;

means for mutually engaging said choke lever and said throttle lever in a first angular range of the position of said choke shaft and a corresponding second angular range of the position of said throttle shaft; and, in said second angular range, an idle position, a warm-start position and a cold-start position are provided arranged one behind the other.

2. The carburetor arrangement of claim 1, wherein said choke flap has an open position; and, said choke shaft is spring biased in a direction toward said open position.

3. The carburetor arrangement of claim 1, wherein said choke flap has an open position and a closed position; and, said carburetor arrangement further comprising a spring-biased latching element for holding said choke flap in said open position and said closed position.

4. The carburetor arrangement of claim 3, wherein said spring-biased latching element operates on said choke shaft.

5. The carburetor arrangement of claim 3, wherein said throttle shaft is spring-biased in closing direction.

6. The carburetor arrangement of claim 5, wherein a resulting torque acts on said choke shaft in the closing direction of said choke flap when said choke and throttle shafts are in said cold-start position.

7. The carburetor arrangement of claim 5, said engaging means comprising a throttle lever attached to said throttle shaft and a choke lever attached to said choke shaft; and, said throttle lever being decoupled from said choke lever in the opening direction of said throttle flap.

8. The carburetor arrangement of claim 7, wherein said choke lever includes an indent; and, said throttle lever latches into said indent in said warm-start position.

9. The carburetor arrangement of claim 8, wherein said levers conjointly define an arcuate interface at said indent.

10. The carburetor arrangement of claim 8, wherein said throttle lever is in contact engagement with a side of said choke lever in said cold-start position.

11. The carburetor arrangement of claim 1, further comprising a gear assembly for operatively connecting said operator-controlled element to said choke shaft.

12. The carburetor arrangement of claim 11, wherein said gear assembly has a transmission ratio from said operator-controlled element to said choke shaft of greater than one.

13. The carburetor arrangement of claim 1, wherein said operator-controlled element is attached to said choke shaft so that it cannot rotate relative thereto.

14. The carburetor arrangement of claim 1, wherein said operator-controlled element is decoupled from said choke shaft in the closing direction; and, said operator-controlled element has an ignition-off position at a specific angular spacing thereof.

15. The carburetor arrangement of claim 1, further comprising a latch element in the operating direction of said choke flap in said idle position.

* * * * *